US009468832B1

(12) United States Patent
Faucette

(10) Patent No.: US 9,468,832 B1
(45) Date of Patent: Oct. 18, 2016

(54) FOOT MOUNTABLE GOLFING AID

(71) Applicant: Fighting Golf, LLC, Ashburn, VA (US)

(72) Inventor: Tiffany Faucette, Ashburn, VA (US)

(73) Assignee: FIGHTING GOLF, LLC, Ashburn, VA (US)

( * ) Notice: Subject to any disclaimer, the term of this patent is extended or adjusted under 35 U.S.C. 154(b) by 0 days.

(21) Appl. No.: 14/813,288

(22) Filed: Jul. 30, 2015

(51) Int. Cl.
*A63B 69/36* (2006.01)

(52) U.S. Cl.
CPC ..... *A63B 69/3667* (2013.01)

(58) Field of Classification Search
USPC ..... 473/217, 218, 257, 270, 272, 273
See application file for complete search history.

(56) References Cited

U.S. PATENT DOCUMENTS 3,175,827 A * 3/1965 Livingood ..... A63B 69/3608 33/262
3,343,842 A * 9/1967 Woerner ..... A63B 69/3667 473/217
5,599,240 A * 2/1997 Feldmeier ..... A63B 69/3623 473/218
5,947,832 A * 9/1999 Gagne ..... A63B 69/3667 473/217
7,261,653 B2 * 8/2007 Thornburg ..... A63B 69/3667 473/266
7,431,661 B1 * 10/2008 Cailey ..... A63B 67/02 473/257
7,722,473 B1 * 5/2010 Shah ..... A63B 69/3608 473/218
7,758,438 B1 7/2010 Colomberti
2009/0118027 A1 * 5/2009 Safstrom ..... A63B 69/3608 473/217

* cited by examiner

*Primary Examiner* — Nini Legesse
(74) *Attorney, Agent, or Firm* — Buchanan Ingersoll & Rooney PC

(57) ABSTRACT

A foot mountable golfing aid is operable to provide a reference path for a swing of a golfer, indicate a swing path, indicate a proper width of stance of a golfer, and/or aid in alignment of a golfer's body in relation to a target when the foot mountable golfing aid is mounted on the foot of a golfer. The foot mountable golfing aid includes a foot attachment component that is configured to be attached to a foot of a golfer, and a vertically adjustable reference component. The vertically adjustable reference component is supported by the foot attachment component. The vertically adjustable reference component is operable to provide a reference path for a swing of a golfer, indicate a swing path, indicate a proper width of stance of a golfer, and/or aid in alignment of a body of a golfer in relation to a target when the foot mountable golfing aid is attached to the foot of a golfer.

27 Claims, 4 Drawing Sheets

FOOT MOUNTABLE GOLFING AID

FIELD OF THE INVENTION

This invention pertains to golf aids, and may find particular use in golf aids that are attachable to the foot of a golfer.

BACKGROUND

Golf is a complex sport that involves a summation of human movement and forces prior to, during and after ball contact. Golf aids can help a golfer improve their game. Some devices vary tremendously, while others have only minor variations that separate them; therefore, even subtle differences can make a large difference in a complex series of alignments and movements involved in every golf stroke. Further, many prior golf aids are placed on the ground, and picked up and moved, each time a golfer wants to change location. Other golfing aids can damage putting greens and are burdensome to walk with. Thus, there is a need for a foot mountable golfing aid that is not burdensome to walk with and does not damage putting greens.

SUMMARY

Disclosed herein is a foot mountable golfing aid that is operable to provide a reference path for a swing of a golfer, indicate a swing path, indicate a proper width of stance of a golfer, and/or aid in alignment of a body of a golfer in relation to a target when the foot mountable golfing aid is mounted on the foot of a golfer. The foot mountable golfing aid includes a foot attachment component that is configured to be attached to a foot of a golfer, and a vertically adjustable reference component. The vertically adjustable reference component is supported by the foot attachment component. The vertically adjustable reference component is operable to provide a reference path for a swing of a golfer, indicate a swing path, indicate a proper width of stance of a golfer, and/or aid in alignment of a body of a golfer in relation to a target when the foot mountable golfing aid is attached to the foot of a golfer.

BRIEF DESCRIPTION OF THE DRAWING FIGURES

DETAILED DESCRIPTION

Figure 1A:
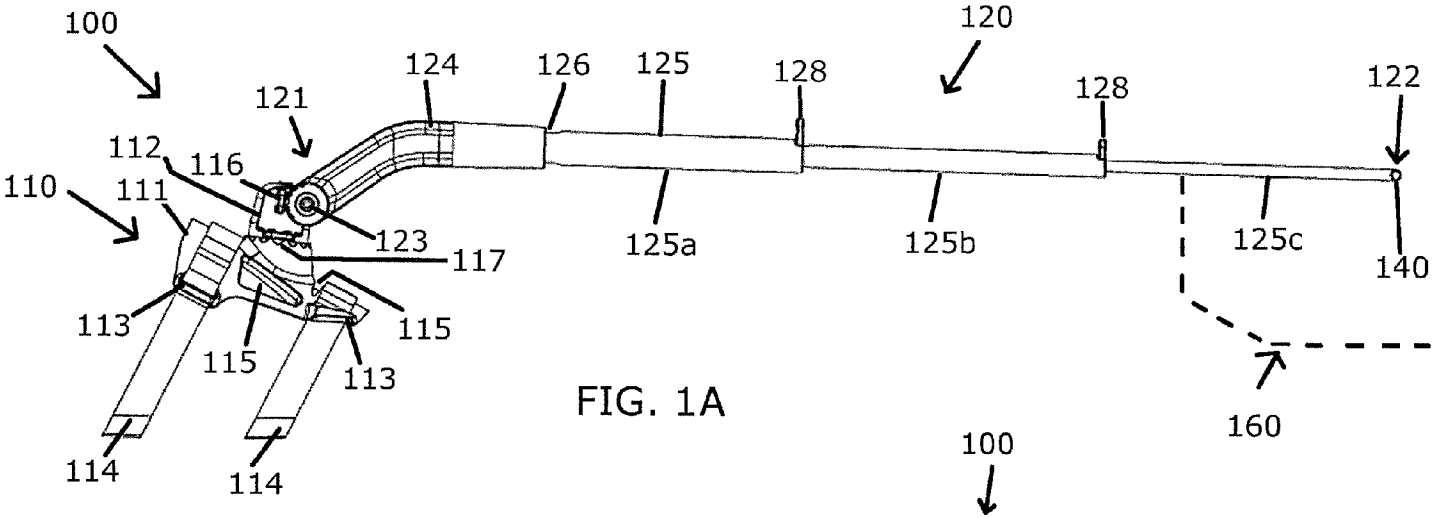
FIG. 1A illustrates an embodiment of a foot mountable golfing aid according to an embodiment as disclosed herein.

In the following detailed description, numerous specific embodiments are set forth in order to provide a thorough understanding of the golfing aid apparatus and methods disclosed herein. However, as will be apparent to those skilled in the art, the present embodiments may be practiced without these specific details or by using alternate elements or processes. In other instances, well-known processes, procedures, and/or components have not been described in detail so as not to unnecessarily obscure aspects of embodiments disclosed herein. As used herein, the terms "swing" and "stroke" may refer to a putting stroke, a partial swing, chipping stroke, or a full swing. As used herein, the terms "vertical" and "vertically" are in relation to a direction perpendicular to ground, and the terms "horizontal" and "horizontally" are in relation to a direction parallel to the ground. As used herein, the terms "shoe" and "foot" both refer to a shoe or a foot of a golfer or user of embodiments of the apparatus as disclosed herein. As used herein, "reference path" may refer to a swing path, a swing plane, and/or a swing alignment.

As indicated, present embodiments provide a foot mountable golfing aid ("golfing aid") that is operable to provide a reference path for a swing of a golfer, indicate a swing path, indicate a proper width of stance of a golfer, and/or aid in alignment of a body of a golfer in relation to a target when the foot mountable golfing aid is mounted on the foot of a golfer. Additionally, the golfing aid can indicate the height of the club through the impact area. The foot mountable golfing aid includes a foot attachment component that can be attached to a foot of a golfer, and a reference component that provides a reference for a swing or putting stroke of a golfer. Preferably, the reference component is a vertically adjustable reference component. The vertically adjustable reference component is supported by the foot attachment component. The vertically adjustable reference component is vertically adjustable and operable to indicate a swing plane and provide a reference path for a swing of a golfer, indicate a proper width of stance of a golfer, and/or aid in alignment of a body of a golfer in relation to a target when the foot mountable golfing aid is attached to the foot of a golfer and the vertically adjustable reference component is adjusted to a desired height. Depending on the height of the golfer as well as the type of swing the golfer intends to perform (i.e. full swing or putting stroke) the desired vertical height of the vertically adjustable reference component may vary.

The foot mountable golfing aid can be worn on either foot of a golfer, preferably a golfer wears the foot mountable golfing aid on each foot during practice of a golf swing. Wearing the golfing aid on the front foot can help train certain swing elements that are different from swing elements that may be trained when a golfer wears the golfing aid on the back foot.

The golfing aid can include a vertically adjustable reference component used to provide a reference path for a putting stroke, chipping stroke, or full swing of a golfer that can be used to improve the putting stroke, chipping stroke, or a full swing of the golfer. During putting, the golfing aid can improve alignment of the club face (i.e. provide a reference perpendicular to a target line for the golfer) as well as help position the feet of a golfer with respect to a target line. The golfing aid can also help a golfer identify their shoulder location, hip location, knee location, the putter club head height during a stroke, and ball position. For different swings the vertically adjustable reference component can be adjusted to different heights to accommodate different lie angles and lengths of the different golf clubs in the set and to adjust to the posture and stature of a golfer.

During a full swing, the golfing aid can help improve a golfer's swing path, alignment, shoulder plane, weight transfer, stance, ball position, and hand path. For example, the golf aid can include a vertically adjustable reference component which is positioned between a golfer's feet and a golf ball wherein the vertically adjustable reference component helps a golfer identify the path a club should travel through impact of the golf ball. In an embodiment, wearing the golfing aid on the back foot helps a golfer work on the swing path of the take away, while wearing the golfing aid on the front foot helps work on swing path on the follow through.

The golfing aid can improve alignment, as the club face can be easily seen while wearing the golfing aid, and in an embodiment it is easy to see if the club face is perpendicular to the cross-bar of the golfing aid. The golfing aid can help a golfer ensure that their feet are parallel. Additionally, the golfing aid can help a golfer ensure that their toe line is parallel to their intended target line. Further, the golf aid can help a golfer identify whether their shoulders, hips, and/or knees are square. In an embodiment, the golfing aid helps a golfer learn how to turn their torso.

In an embodiment, the reference component of the golfing aid can include a boom or rod that extends outwardly from the foot of a golfer, and a cross-bar at the end of the boom which can be perpendicular or substantially perpendicular to the boom. Preferably, the cross-bar is straight however in an alternate embodiment the cross-bar can include one or more bends, such as at either of the ends thereof. The cross-bar or a portion of the cross-bar preferably runs parallel to a target line of the golfer. Thus, when the golfing aid is worn on the front foot, the club head should travel under a portion of cross-bar, when the cross-bar is set to parallel (i.e. horizontal) to the ground, from the impact of the golf ball until the club head reaches the front foot. In order for this to occur a proper weight shift should also occur.

The golf aid can also help a golfer obtain a proper width of stance. For example, in an embodiment, the cross-bar may be moved from a horizontal position to a vertical position. When in the vertical position, the shin bones of a golfer should be in line with the vertical portion of the cross-bar. This ensures proper width of stance based on bone structure so that a golfer can make a backswing without sway.

The cross-bar of the reference component can also include markings thereon, such that a golfer can consistently position the ball with respect to their body. Additionally, to ensure a proper hand path, a golfer must take the club back wherein their hands stay between a portion of the cross-bar that is parallel to the target line and their legs. The hands should not go outside of the cross-bar. On the way down during a swing, the hands should return from inside the cross-bar to ensure a good path. If the hands come from outside the cross-bar on the downswing, a golfer will be coming over the top of the swing plane and the golfer will have a path that does not promote a straight shot.

FIGS. 1A-1D illustrate a preferred embodiment of a foot mountable golfing aid 100 according to an embodiment as disclosed herein. As shown in FIGS. 1A-1D, the foot mountable golfing aid 100 includes a foot attachment component 110 that is configured to be attached to a foot of a golfer during use, and a vertically adjustable reference component 120 that is supported by the foot attachment component 110. The vertically adjustable reference component 120 is operable to provide a reference path for a swing of a golfer, indicate a swing path, indicate a proper width of stance of a golfer, and/or aid in alignment of a golfer's body in relation to a target when the foot mountable golfing aid 100 is attached to the foot of a golfer. The vertically adjustable reference component 120 can include a first end portion 121 pivotally attached to the foot attachment component 110 at a pivot 123. The vertically adjustable reference component 120 can also include a second end portion 122 that is outward of the first end portion 121 such that the second end portion 122 may be vertically adjusted by rotating the vertically adjustable reference component 120 around the first end portion 121. The second end portion 122 preferably provides a reference path for a swing of a golfer when the foot mountable golfing aid is attached to the foot of a golfer.

In an embodiment, the second end portion 122 can include one or more lasers 140 (see FIG. 1A) that provide a reference path for a swing of a golfer wherein the one or more lasers 140 can be directed towards the ground and/or outwardly. For example, in an embodiment, the one or more lasers 140 can be configured to illustrate a linear reference path on the ground wherein the reference path can be configured to be parallel to a desired target line of a stroke of a golfer. In a further embodiment, the one or more lasers 140 can be located at any position on the foot mountable golfing aid 100.

In an embodiment, the vertically adjustable reference component 120 can include a base 124 at the first end portion 121 of the vertically adjustable reference component 120. The base 124 has an opening 126 in which a boom 125 that extends outwardly from the base 124 is located. Preferably, the opening 126 is a through opening that extends completely through a portion of the base 124. The opening 126 preferably includes the boom 125 therein such that the boom 125 is movable within the opening 126 of the base 124 wherein the boom 125 may be movable among a retracted position, intermediate positions, and an extended position. In an embodiment, the boom 125 may be friction fit in the base 124 such that the position of the boom 125 may be finely adjusted within the base 124. In a preferred embodiment, the opening 126 of the base can include at least one groove (not shown) wherein at least one rail (not shown) on the boom 125 is fitted in the groove such that the boom 125 is aligned in the base 124, or in an alternate embodiment the base can include at least one rail that is fitted in a groove of the boom.

In an alternate embodiment, the vertically adjustable reference component 120 can include a boom 125 having a first end portion pivotally attached to the foot attachment component 110 and a second end portion outward of the first end portion. The second end portion may be vertically adjusted by rotating the vertically adjustable reference component around the first end, wherein the second end portion provides the reference path for a swing of a golfer when the foot mountable golfing aid is attached to the foot of a golfer. In an alternative embodiment, the vertically adjustable reference component can include a boom 125 that can have a first portion that is vertical or substantially vertical to the foot attachment component 110 and a second portion that extends horizontally from the first portion. The first section of the boom 125 in this embodiment may be extendable such that the vertical height of the boom may be increased or decreased. Likewise, the second section of the boom can be extendable such that the horizontal length of the boom may be increased or decreased.

Referring back to FIGS. 1A-1D, the boom 125 can include a cross-bar 129 at the end thereof wherein the cross-bar 129 is configured to provide a reference path for a swing of a golfer when the foot mountable golfing aid is attached to the foot of a golfer. Preferably the cross-bar 129 extends perpendicular to the length of the boom 125. In an embodiment, the cross-bar 129 may be integral with the boom 125, in an alternative embodiment, the cross-bar 129 may be attached to the end of the boom 125 with screws or the like. For example, the cross-bar 129 may include two pieces that each screw into the boom 125, such that the cross-bar 129 may be removed. In a different embodiment, the cross-bar 129 can be a single piece that screws into the end of the boom 125. In an embodiment, the cross-bar 129 can include a level 141, such as a bubble level or digital level, wherein the level may indicate the slope of the ground in which a golfer is standing. The level 141 can indicate to a golfer when the golfer needs to adjust ball position or their stance such as when a golf ball has an uneven lie in the fair way. Preferably the level 141 is at the center of the cross-bar 129 (see FIG. 1B), however the level 141 can be included in any position on the golfing aid 100. In an embodiment, the level 141 and/or the laser 140, as well as other electronic functions of the golfing aid 100, can communicate with a golfer's cell phone via a cell phone application and blue tooth or the like. In this embodiment, the golf aid 100 includes the necessary electrical components such as a logic controller, power source, and the like.

In an embodiment, the foot attachment component 110 can include a contoured plate 111 that is configured to fit against an upper portion of a foot or shoe of a golfer when attached to the foot of a golfer. Preferably, the contoured plate 111 is contoured such that the foot attachment component 110 can be attached to the left or right foot of golfer, however in a further embodiment, the contoured plate 111 can be contoured for a right foot of a golfer or a left foot of a golfer. The contoured plate 111 preferably includes openings 113 therein that receive straps 114 (see FIG. 1A) that are operable to attach the foot mountable golfing aid 100 to the foot of a golfer. The straps 114 can be any type of straps that are operable to affix the foot mountable golfing aid 100 to the foot of a golfer such as straps that are tie-able, straps that are elastic, straps that include buckles, straps that include a tightening device, or straps that are velcro straps. The contoured plate 111 preferably includes a soft pad on a lower surface thereof, so as to provide cushioning between the foot attachment component 110 and the foot or shoe of a golfer. Furthermore, as the contoured plate 111 is preferably formed of plastic, the pad can reduce scuffing of a golfer's shoe during use of the foot mountable golfing aid 100.

In an embodiment, an upper portion of the contoured plate 111 of foot attachment component 110 includes a rotatable turret 112 which supports the vertically adjustable reference component 120 such that the vertically adjustable reference component 120 may be horizontally rotated (or translated) about the rotatable turret 112. The contoured plate 111 preferably also includes one or more cut outs 115 that preferably each extend between an upper and the lower surface of the contoured plate 111. The one or more cutouts 115 are configured to increase the flexibility of the contoured plate, such that a golfer has increased flexibility during practice with the foot mountable golfing aid 100 and can also bend their toes during use.

In an embodiment, the foot attachment component 110 and/or the vertically adjustable reference component 120 include a locking mechanism 116 that is operable to lock the vertically adjustable reference component in place such that the vertical height of the vertically adjustable reference component 120 may be fixed. During different types of swings such as a full swing or a putting stroke, the vertical height of the vertically adjustable reference component 120 is preferably set to a desired position. Preferably, the locking mechanism 116 is a spring loaded lock (see FIGS. 3A and 3B), a tab in groove lock (see FIGS. 1A-1D), or a tightenable fastener. In a preferred embodiment, the rotatable turret 112 includes a locking mechanism 117 that is operable to lock the vertically adjustable reference component 120 in place such that the horizontal position of the vertically adjustable reference component 120 may be fixed. Preferably, the locking mechanism 117 is a spring loaded lock (see FIGS. 3A and 3B), a tab in groove lock (see FIGS. 1A-1D), or a tightenable fastener.

The vertically adjustable reference component 120 is preferably extendable such that the horizontal distance that an end portion of the vertically adjustable reference component 120 is from a golfer may be set. For example, the boom 125 is preferably a telescoping boom 125 having at least first and second sections wherein the second section can extend into and out of the first section. For example, as shown in FIGS. 1A-1D, the boom 125 preferably includes a first section 125*a*, a second section 125*b*, and a third section 125*c* wherein the third section 125*c* can telescope into the second section 125*b* and the second section 125*b* can telescope into the first section 125*a*. In a preferred arrangement, the first section 125*a* can telescope into the base 124. Preferably the first section 125*a*, the second section 125*b*, and/or the third section 125*c* include finger tabs 128 that aid a golfer in extending or retracting a respective section of the boom 125.

Figure 1B:
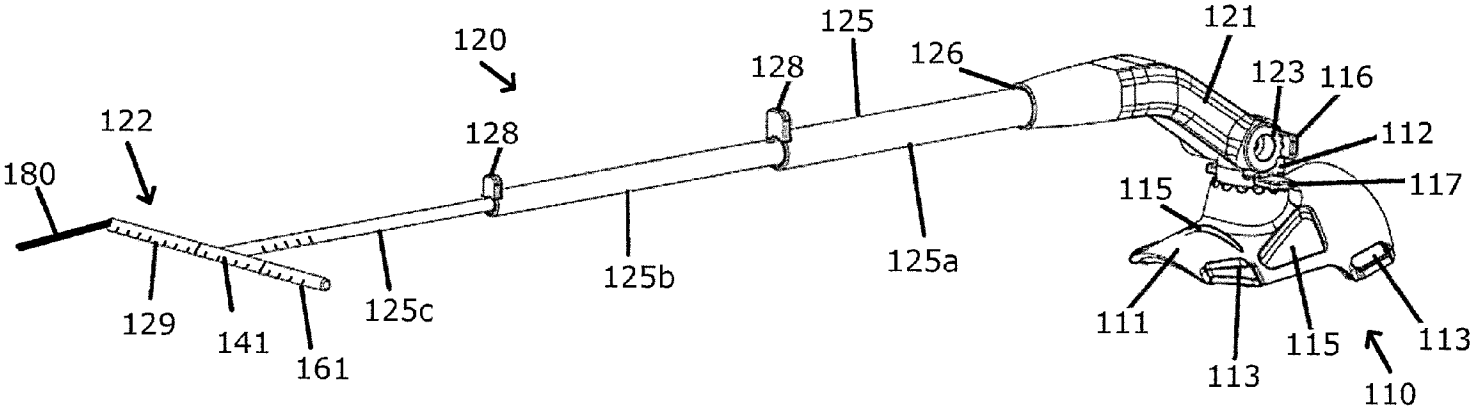
FIG. 1B illustrates an embodiment of a foot mountable golfing aid according to an embodiment as disclosed herein.
Figure 1C:
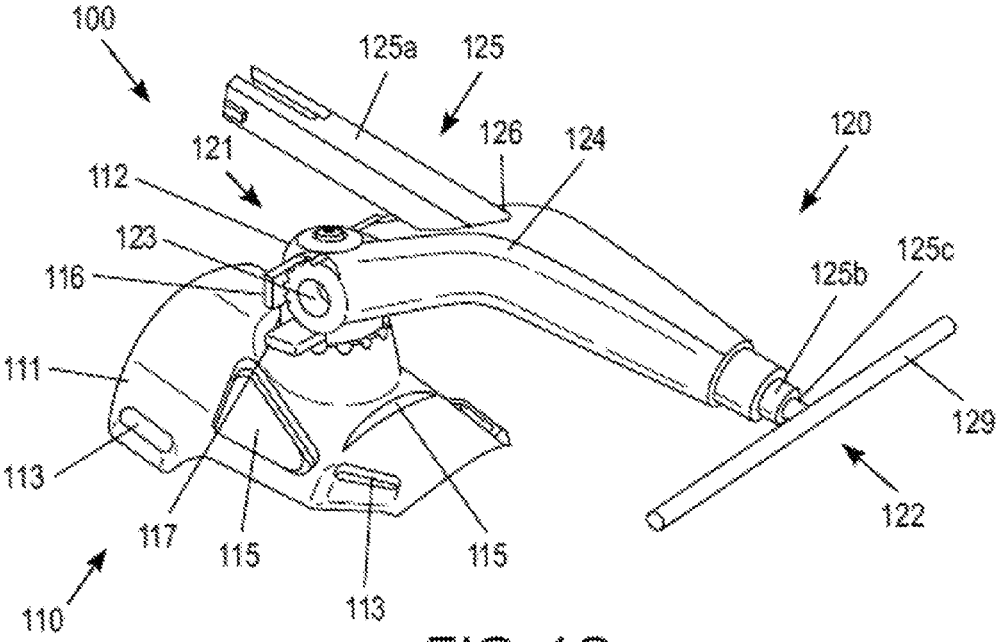
FIG. 1C illustrates an embodiment of a foot mountable golfing aid according to an embodiment as disclosed herein.
Figure 1D:
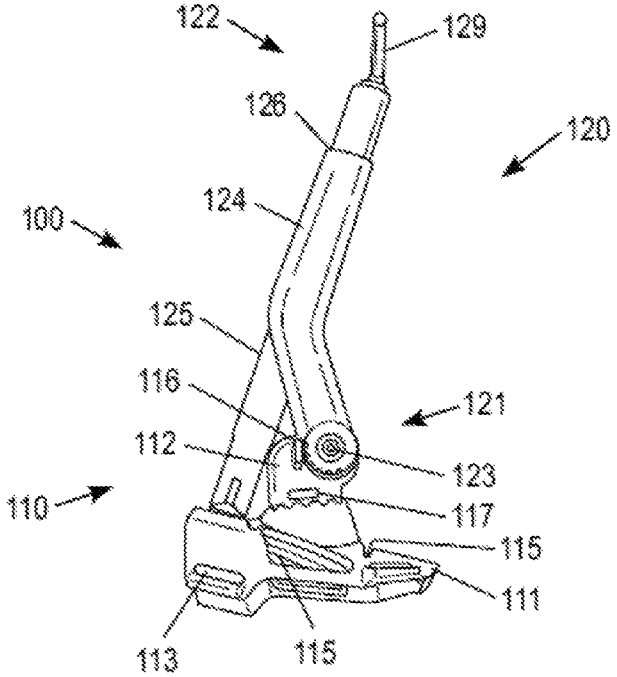
FIG. 1D illustrates an embodiment of a foot mountable golfing aid according to an embodiment as disclosed herein.

As shown in FIGS. 1A and 1B, the first, second, and third sections 125*a*, 125*b*, and 125*c* of the boom 125 are in an extended position, and as shown in FIGS. 1C and 1D, the first, second, and third sections 125*a*, 125*b*, and 125*c* of the boom 125 are in retracted position. When the first, second, and third sections 125*a*, 125*b*, and 125*c* of the boom 125 are in the retracted position, a golfer may easily walk to different locations on a golf course without the golfing aid 100 obstructing the golfer's walking path. Thus, the foot mountable golfing aid 100 is mobile with the golfer and easily usable. Therefore, a golfer can increase practice efficiency as the golfer does not need to remove the foot mountable golfing aid 100 during practice, and can adjust the golfing aid 100 to a multitude of positions for each upcoming stroke during a practice session. In this manner, a golfer can use the golfing aid 100 during practice and/or during a recreational round of golf.

In an embodiment a first section of the telescoping boom 125 can be hollow and can include at least one groove in the interior thereof and the second section of the telescoping boom 125 can include at least one rail on an exterior thereof. In this embodiment the rail of the second section fits in the groove of the first section such that the second section is aligned with the first section and the second section may be telescoped into and out of the first section. Preferably, the first section comprises two grooves in the interior thereof and the second section comprises two corresponding rails on the exterior thereof. The rails of the second section preferably provide a friction fit in the respective grooves such that second section can be telescoped within the first section to a predetermined position.

In an embodiment, the foot mountable golfing aid 100 can include a movable ball marker 160 that allows a golfer to mark the position of a golf ball. As shown in FIG. 1A, the movable ball marker 160 is located on the boom 125, however, in an alternate embodiment, the movable ball marker 160 can be located on the foot attachment component 110. In another embodiment, the cross-bar 129 and/or a portion of the boom 125 can include a position indicator 161 to indicate a relationship between a foot of a golfer and the position of a golf ball such that a golfer can consistently locate the ball at a proper position. In an embodiment, the position indicator 161 can include markings with predetermined angles, or alternatively the position indicator 161 can be a measurement device such as a ruler. In an additional embodiment, the cross-bar 129 can include a backswing rail 180 (see FIG. 1B) that is operable to limit the back swing of a golfer. The back swing rail 180 is preferably adjustable, and more preferably removable from the cross-bar 129.

Figure 2:
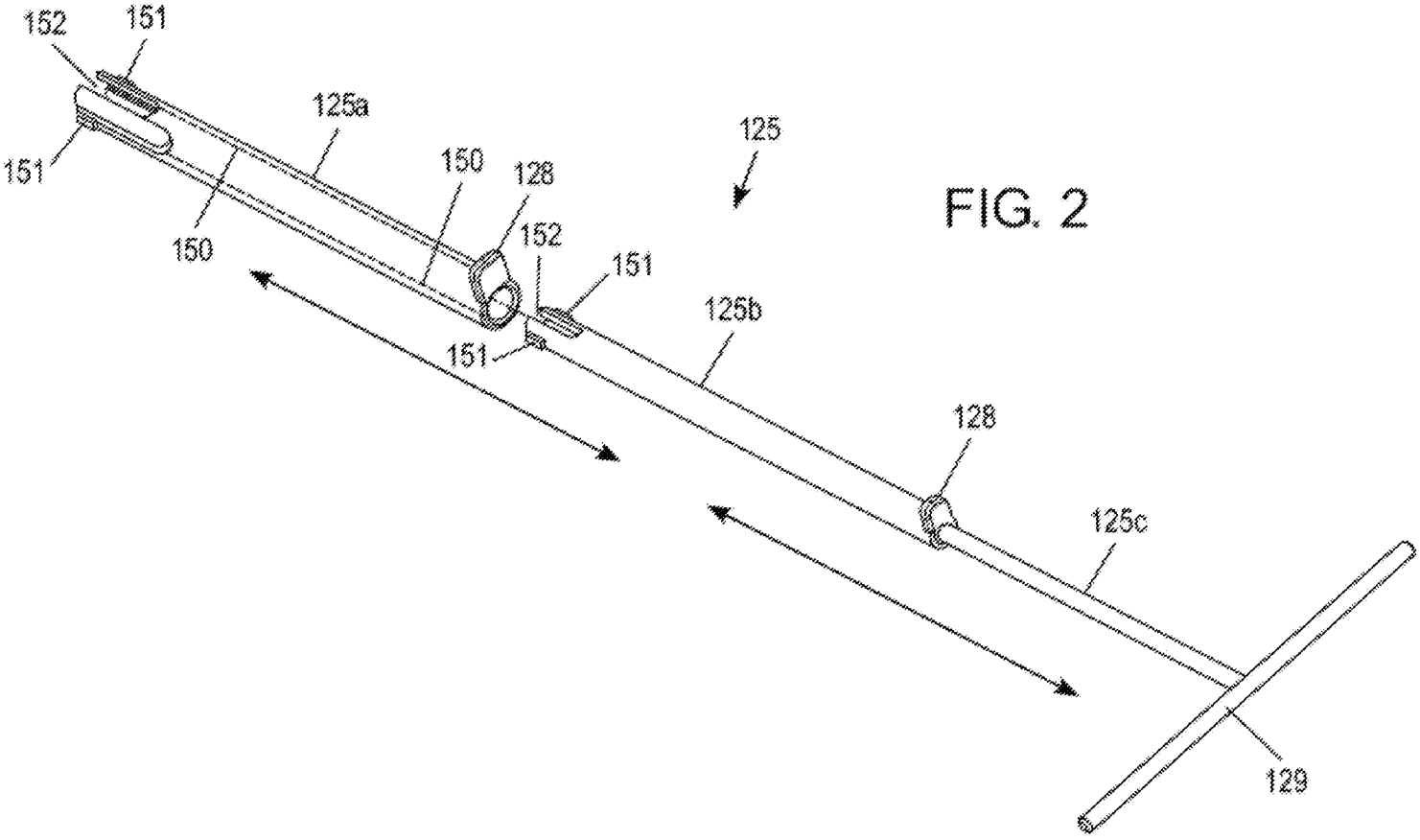
FIG. 2 illustrates an embodiment of a boom of a foot mountable golfing aid according to an embodiment as disclosed herein.

FIG. 2 illustrates a preferred embodiment of a telescoping boom. As shown in FIG. 2, the boom 125 preferably includes a first section 125*a*, a second section 125*b*, and a third section 125*c* wherein the third section 125*c* can telescope into the second section 125*b* and the second section 125*b* can telescope into the first section 125*a*. The first section 125*a* is preferably hollow and includes two grooves (i.e. guides) 150 in which two rails 151 of the second section 125*b* are inserted. The second section 125*b* is also preferably hollow and includes two grooves or guides (not shown) in which two rails (not shown) of the third section 125*c* are inserted. Likewise, the first section 125*a* can include two rails 151 that are fitted into the base 124 of the vertically adjustable reference component 120. Preferably, the first, second, and third sections 125*a*, 125*b*, 125*c* each include a cut out 152 at respective ends thereof, such that the respective ends can be fitted into an adjacent section or base and provide a friction fit within the grooves 150 such that the horizontal position of the cross-bar 129 can be finely adjusted. The first, second, and/or third sections 125*a*, 125*b*, 125*c* of the boom 125 can also include finger tabs 128 that aid a golfer in extending or retracting a respective section to a desired location.

Figure 3A:
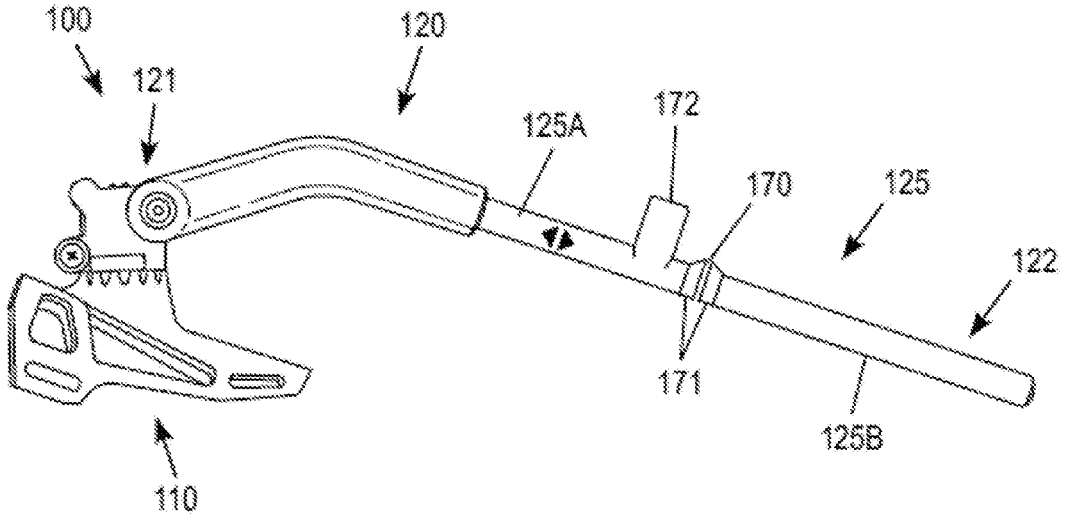
FIG. 3A illustrates an embodiment of a foot mountable golfing aid according to an embodiment as disclosed herein.
Figure 3B:
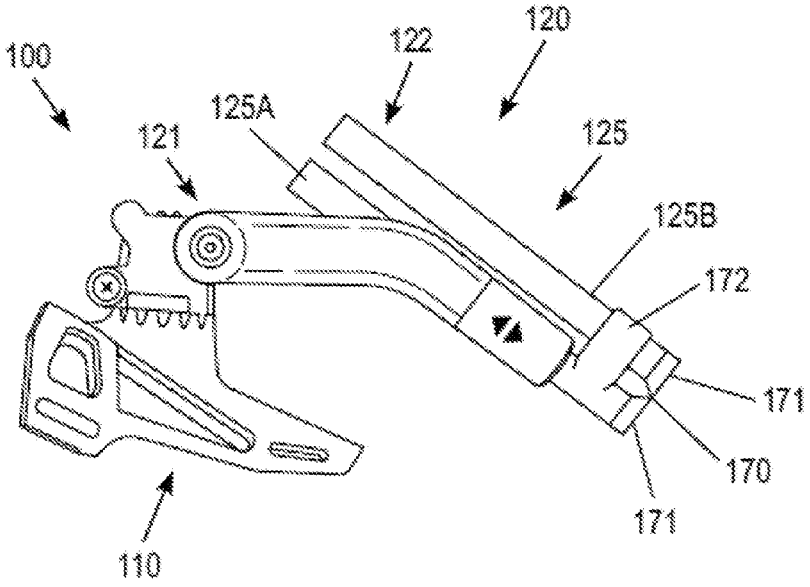
FIG. 3B illustrates an embodiment of a foot mountable golfing aid according to an embodiment as disclosed herein.

In an embodiment, the vertically adjustable reference component 120 can include a hinge 170 along a length thereof such that a second end portion 122 of the vertically adjustable reference component 120 can be folded towards a first end portion 121 of the vertically adjustable reference component 120. For example, FIGS. 3A and 3B illustrate an embodiment of a foot mountable golfing aid 100 in which the boom 125 includes a hinge 170 along the length thereof such that the boom 125 includes first and second sections 125*a*, 125*b* wherein the second section 125*b* can be folded towards the first section 125*a*. In the folded upright position (see FIG. 3B), a golfer can easily walk from spot to spot on a golf course, practice field, or practice green. In a preferred embodiment, adjacent portions of the first and second sections 125*a*, 125*b* include a magnet therein such that the respective sections are may be firmly fixed together when the boom 125 is in the extended position (see FIG. 3A). The first section 125*a* preferably includes a catch such that the second section 125*b* can be locked in place in the folded position.

While the foot mountable golfing aid has been described in detail with reference to specific embodiments thereof, it will be apparent to those skilled in the art that various changes and modifications can be made, and equivalents employed, without departing from the scope of the appended claims.

What is claimed:

1. A foot mountable golfing aid operable to provide a reference path for a swing of a golfer, indicate a swing path, indicate a proper width of stance for a golfer, and/or aid in alignment of a body of a golfer in relation to a target when the foot mountable golfing aid is mounted on a foot of a golfer, the foot mountable golfing aid comprising:

a foot attachment component that is configured to attach to a foot of a golfer; and a vertically adjustable reference component including a first end portion coupled to the foot attachment component at a pivot and a second end portion outward of the first end portion, the second end portion including a cross-bar wherein position of the cross-bar can be adjusted with respect to the foot attachment component by rotating the second end portion about the pivot, the vertically adjustable reference component operable to provide a reference path for a swing of a golfer, indicate a swing path, indicate a proper width of stance for a golfer, and/or aid in alignment of a body of a golfer in relation to a target when the foot mountable golfing aid is attached to a foot of a golfer.

2. The foot mountable golfing aid of claim 1, wherein the first end portion of the vertically adjustable reference component includes a base wherein the base is coupled to the pivot.

3. The foot mountable golfing aid of claim 2, wherein the vertically adjustable reference component includes a boom that extends between the first and second end portions thereof wherein the boom is supported by the base of the first end portion and the cross-bar of the second end portion extends outwardly from the boom.

4. The foot mountable golfing aid of claim 3, wherein the boom is located in an opening of the base wherein the boom is movable within the opening between a retracted position and an extended position such that a distance between the cross-bar and the base may be adjusted.

5. The foot mountable golfing aid of claim 3, wherein the boom is a telescoping boom having at least first and second sections, or the boom includes a hinge along a length thereof such that the second end portion of the vertically adjustable reference component can be folded towards the first end portion of the vertically adjustable reference component.

6. The foot mountable golfing aid of claim 1, further including a locking mechanism operable to lock the vertically adjustable reference component in place such that the position of the cross-bar may be fixed.

7. The foot mountable golfing aid of claim 6, wherein the locking mechanism is a spring loaded lock, a tab in groove lock, or a tightenable fastener.

8. The foot mountable golfing aid of claim 1, wherein the vertically adjustable reference component includes a telescoping boom extending between the first and second end portions thereof, the telescoping boom having at least first and second sections, wherein the first section is hollow and includes at least one groove in an interior thereof and the second section includes at least one rail on an exterior thereof, wherein the rail of the second section fits in the groove of the first section such that the second section is aligned with the first section and the second section may be telescoped into and out of the first section such that the distance between the first and second end portions may be adjusted.

9. The foot mountable golfing aid of claim 8, wherein the telescoping boom includes a third section, wherein the second section is hollow and includes at least one groove in an interior thereof and the third section includes at least one rail on an exterior thereof, wherein the rail of the third section fits in the groove of the second section such that the third section is aligned with the second section and the third section may be moved within the second section to a predetermined position.

10. The foot mountable golfing aid of claim 8, wherein the first section includes two grooves in the interior thereof and the second section includes two corresponding rails on the exterior thereof, wherein the rails are operable to provide a friction fit in the respective grooves such that the second section can be moved within the first section to a predetermined position.

11. The foot mountable golfing aid of claim 1, wherein;

(a) the foot attachment component includes a laser wherein the laser is configured to provide a reference path for a swing of a golfer when the foot mountable golfing aid is attached to a foot of a golfer;

(b) the foot attachment component includes a level wherein the level is configured to indicate a slope of the ground;

(c) the foot attachment component includes a movable ball marker configured to mark the position of a golf ball;

(d) the foot attachment component includes a position indicator configured to indicate a relationship between a foot of a golfer and the position of a golf ball;

(e) the foot attachment component includes a contoured plate having an upper surface and a lower surface wherein the pivot is attached to the upper surface and the lower surface is configured to fit against an upper portion of a foot of a golfer when the foot attachment component is attached to a foot of a golfer; and/or (f) the foot attachment component includes a contoured plate having an upper surface and a lower surface wherein the lower surface is configured to fit against an upper portion of a foot of a golfer when the foot attachment component is attached to a foot of a golfer and the upper surface of the contoured plate includes a rotatable turret which is attached to the pivot such that the vertically adjustable reference component may be horizontally rotated about the rotatable turret or vertically rotated about the pivot.

12. The foot mountable golfing aid of claim 1, wherein;

(a) the vertically adjustable reference component has at least first and second sections wherein the second section telescopes into the first section;

(b) the vertically adjustable reference component includes a hinge along a length thereof such that the second end portion of the vertically adjustable reference component can be folded towards the first end portion of the vertically adjustable reference component;

(c) the cross-bar extends outwardly from the second end portion;

(d) the vertically adjustable reference component includes a laser wherein the laser is configured to provide a reference path for a swing of a golfer when the foot mountable golfing aid is attached to a foot of a golfer;

(e) the foot mountable golfing aid includes a level wherein the level is configured to indicate a slope of the ground;

(f) the foot mountable golfing aid includes a movable ball marker configured to mark the position of a golf ball;

(g) the vertically adjustable reference component includes a removable backswing rail; and/or (h) the vertically adjustable reference component includes a position indicator configured to indicate a relationship between a foot of a golfer and the position of a golf ball.

13. The foot mountable golfing aid of claim 1, wherein the vertically adjustable reference component includes a boom that extends between the first end portion and the second end portion thereof.

14. The foot mountable golfing aid of claim 13, wherein;

(a) the boom is a telescoping boom having at least first and second sections;

(b) the boom includes a hinge along a length thereof such that the second end portion of the vertically adjustable reference component can be folded towards the first end portion of the vertically adjustable reference component;

(c) the cross-bar extends outwardly from the boom at the second end portion thereof;

(d) the boom or the cross-bar includes a laser wherein the laser is configured to provide a reference path for a swing of a golfer when the foot mountable golfing aid is attached to the foot of a golfer;

(e) the boom or the cross-bar includes a level wherein the level is configured to indicate a slope of the ground;

(f) the boom or the cross-bar includes a movable ball marker configured to mark the position of a golf ball;

(g) the boom or the cross-bar includes a removable backswing rail, the backswing rail operable to limit the back swing of a golfer;

(h) the boom or the cross-bar includes a position indicator configured to indicate a relationship between a foot of a golfer and the position of a golf ball;

(i) the boom is a telescoping boom having at least first and second sections wherein at least one section includes a finger tab configured to aid a golfer in extending and retracting a respective section of the telescoping boom;

(j) the boom is a telescoping boom having at least first and second sections wherein the second section includes a cut out at an end thereof which is inserted into the first section, the cut out operable to provide a resilient friction fit in an interior of the first section such that the second section can be adjusted within the first section;

(k) the cross-bar extends outwardly from the boom at the second end portion thereof wherein the cross-bar is perpendicular to the boom;

(l) the cross-bar extends outwardly from the boom at the second end portion thereof so as to form a t-shape;

(m) the cross-bar extends outwardly from a distal end of the boom wherein the cross-bar is perpendicular to the boom;

(n) the cross-bar extends outwardly from a distal end of the boom so as to form a t-shape; and/or (o) the cross-bar includes a curved portion.

15. A foot mountable golfing aid operable to provide a reference path for a swing of a golfer, indicate a swing path, indicate a proper width of stance for a golfer, and/or aid in alignment of a body of a golfer in relation to a target when the foot mountable golfing aid is mounted on a foot of a golfer, the foot mountable golfing aid comprising:

a foot attachment component that is configured to attach to a foot of a golfer; and a vertically adjustable reference component that is supported by the foot attachment component, the vertically adjustable reference component operable to provide a reference path for a swing of a golfer, indicate a swing path, indicate a proper width of stance for a golfer, and/or aid in alignment of a body of a golfer in relation to a target when the foot mountable golfing aid is attached to a foot of a golfer; wherein the foot attachment component includes a contoured plate having an upper surface and a lower surface wherein the lower surface is configured to fit against an upper portion of a foot of a golfer when the foot attachment component is attached to a foot of a golfer.

16. The foot mountable golfing aid of claim 15, wherein:

(a) the upper surface of the contoured plate of the foot attachment component includes a rotatable turret which supports the vertically adjustable reference component such that the vertically adjustable reference component may be horizontally rotated about the rotatable turret;

(b) the contoured plate is contoured for a right foot of a golfer or a left foot of a golfer;

(c) the contoured plate includes openings configured to receive straps that are operable to attach the foot mountable golfing aid to the foot of a golfer;

(d) the contoured plate includes one or more cut outs each extending between the upper and lower surfaces of the contoured plate, wherein the one or more cutouts are operable to increase the flexibility of the contoured plate; and/or (e) the contoured plate includes a pad on the lower surface thereof.

17. The foot mountable golfing aid of claim 16, wherein the openings include straps therein and the straps are tie-able straps, the straps are elastic straps, the straps include buckles, the straps include a tightening device, or the straps are velcro straps.

18. The foot mountable golfing aid of claim 16, wherein the rotatable turret includes a locking mechanism operable to lock the vertically adjustable reference component in place such that the horizontal position of the vertically adjustable reference component may be fixed.

19. The foot mountable golfing aid of claim 18, wherein the locking mechanism is a spring loaded lock, a tab in groove lock, or a tightenable fastener.

20. A foot mountable golfing aid operable to provide a reference path for a swing of a golfer, indicate a swing path, indicate a proper width of stance for a golfer, and/or aid in alignment of a body of the golfer in relation to a target when mounted on a foot of a golfer, the foot mountable golfing aid comprising:

a foot attachment component that is configured to attach to a foot of a golfer; and a vertically adjustable reference component that is supported by the foot attachment component wherein the vertically adjustable reference component is operable to provide a reference path for a swing of a golfer, indicate a swing path, indicate a proper width of stance for a golfer, and/or aid in alignment of a body of the golfer in relation to a target when the foot mountable golfing aid is attached to the foot of a golfer;

wherein the vertically adjustable reference component comprises a boom having a first end portion and a second end portion, the first end portion attached to the foot attachment component and the second end portion including a cross-bar extending perpendicular to the length of the boom, wherein the cross-bar is integral with the boom or wherein the cross-bar may be attached to the end of the boom.

21. The foot mountable golfing aid of claim 20, wherein the first end portion of the boom is movably located in a base, and the foot attachment component includes a contoured plate having a lower surface that is configured to be supported on an upper surface of a foot of a golfer, wherein an upper surface of the contoured plate includes a rotatable turret that is coupled to the base at a pivot such that the position of the cross-bar can be adjusted by rotating the cross-bar about the pivot or by rotating the cross-bar about the rotatable turret such that a golfer can adjust the vertical height and horizontal position of the cross-bar when the foot mountable golfing aid is attached to a foot of a golfer.

22. The foot mountable golfing aid of claim 21, wherein the boom is a telescoping boom operable to telescope inwardly and outwardly such that a distance between the cross-bar and the base may be adjusted.

23. The foot mountable golfing aid of claim 20, wherein:

(a) the cross-bar is perpendicular to the boom;

(b) the cross-bar extends outwardly from the boom so as to form a t-shape;

(c) the cross-bar includes a curved portion;

(d) the boom or the cross-bar includes a laser wherein the laser is configured to provide a reference path for a swing of a golfer when the foot mountable golfing aid is attached to a foot of a golfer;

(e) the boom or the cross-bar includes a level wherein the level is configured to indicate a slope of the ground;

(f) the boom or the cross-bar includes a movable ball marker configured to mark the position of a golf ball;

(g) the boom or the cross-bar includes a removable backswing rail; and/or (h) the boom or the cross-bar includes a position indicator configured to indicate a relationship between a foot of a golfer and the position of a golf ball.

24. A foot mountable golfing aid comprising:

a foot attachment component that is configured to attach to a foot of a golfer; and a vertically adjustable reference component supported by the foot attachment component, the vertically adjustable reference component including a boom that extends outwardly from the foot attachment component, the boom including a cross-bar at an outer end thereof wherein a position of the cross-bar can be adjusted such that a golfer can adjust the vertical height of the cross-bar when the foot mountable golfing aid is attached to a foot of a golfer.

25. The foot mountable golfing aid of claim 24, wherein the foot attachment component includes a contoured plate having a lower surface that is configured to be supported on an upper surface of a foot of a golfer, wherein an upper surface of the contoured plate includes a rotatable turret that is coupled to the vertically adjustable reference component at a pivot such that the position of the cross-bar can be adjusted by rotating the cross-bar about the pivot or by rotating the cross-bar about the rotatable turret such that a golfer can adjust the vertical height and horizontal position of the cross-bar when the foot mountable golfing aid is attached to a foot of a golfer.

26. The foot mountable golfing aid of claim 25, wherein the vertically adjustable reference component includes a base that is coupled to the pivot; and (a) the base includes an opening therethrough wherein the boom is movably located in the opening such that a distance between the cross-bar and the base may be adjusted; and/or (b) the boom is a telescoping boom operable to telescope inwardly and outwardly such that a distance between the cross-bar and the base may be adjusted.

27. The foot mountable golfing aid of claim 24, wherein:

(a) the cross-bar is perpendicular to the boom;

(b) the cross-bar extends outwardly from the boom so as to form a t-shape;

(c) the cross-bar includes a curved portion;

(d) the boom or the cross-bar includes a laser wherein the laser is configured to provide a reference path for a swing of a golfer when the foot mountable golfing aid is attached to a foot of a golfer;

(e) the boom or the cross-bar includes a level wherein the level is configured to indicate a slope of the ground;

(f) the boom or the cross-bar includes a movable ball marker configured to mark the position of a golf ball;

(g) the boom or the cross-bar includes a removable backswing rail;

(h) the boom or the cross-bar includes a position indicator configured to indicate a relationship between a foot of a golfer and the position of a golf ball; and/or (i) the cross-bar is detachable from the boom.

* * * * *